US007007736B2

(12) United States Patent
Suzuki et al.

(10) Patent No.: US 7,007,736 B2
(45) Date of Patent: Mar. 7, 2006

(54) DIE FORMING METHOD FOR FORMING FEMALE SCREW

(75) Inventors: Hideyuki Suzuki, Kariya (JP); Hisashi Kayano, Toyoake (JP); Koichiro Sato, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/751,656

(22) Filed: Jan. 6, 2004

(65) Prior Publication Data

US 2004/0159417 A1 Aug. 19, 2004

(30) Foreign Application Priority Data

Jan. 9, 2003 (JP) ..... 2003-003580

(51) Int. Cl.
*B22D 17/22* (2006.01)

(52) U.S. Cl. ..... 164/132; 164/348

(58) Field of Classification Search ..... 164/132, 164/113, 348
See application file for complete search history.

(56) References Cited

U.S. PATENT DOCUMENTS 5,501,266 A * 3/1996 Wang et al. ..... 164/113
6,460,602 B1 10/2002 Kubota et al.
6,634,412 B1 * 10/2003 Murray et al. ..... 164/113
6,745,821 B1 * 6/2004 Wilson ..... 164/342
2001/0023720 A1 9/2001 Ohori et al.

FOREIGN PATENT DOCUMENTS

| | | | |
|---|---|---|---|
| JP | U-S62-72759 | | 5/1987 |
| JP | A-H02-187243 | | 7/1990 |
| JP | A-H04-52066 | | 2/1992 |
| JP | A-H07-112265 | | 5/1995 |
| JP | A-H08-309505 | | 11/1996 |
| JP | A-H09-1314 | | 1/1997 |
| JP | 10-113758 | * | 5/1998 |
| JP | A-H10-146666 | | 6/1998 |
| JP | A-H10-202353 | | 8/1998 |

* cited by examiner

*Primary Examiner*—Len Tran
(74) *Attorney, Agent, or Firm*—Posz Law Group, PLC

(57) ABSTRACT

A molten magnesium material is filled into a product section of a die. The molten magnesium material is cooled and solidified in the die, so that a molded product is formed. Subsequently, a thread-shaped pin is rotated, so that a female-thread forming section is drawn from the female-thread section of the molded product while the female-thread forming section is rotated. Thus, the female-thread section can be formed when the molded product is formed. A magnesium-alloy material is not apt to stick to a steel material used in the die compared with an aluminum-alloy material, so that the female-thread section can be steadily formed.

16 Claims, 5 Drawing Sheets

DIE FORMING METHOD FOR FORMING FEMALE SCREW

CROSS REFERENCE TO RELATED APPLICATION

This application is based on Japanese Patent Application No. 2003-3580 filed on Jan. 9, 2003, the disclosure of which is incorporated herein by reference.

BACKGROUND OF THE INVENTION

1. Field of the Invention

The present invention is related to a molding method for molding a product which has a female screw section.

2. Description of Related Art

Conventionally, a component is die-cast of an aluminum alloy, and subsequently machining work (i.e., tapping) is performed to the component, so that a connecting component having a female screw is manufactured.

According to JP-A-2-187243, a core pin is provided in a casting die. A molten metallic material is filled into the molding die, and the filled metal is cooled. Subsequently, the core pin is drawn while being rotated, after the filled metal is solidified, so that a component with a female screw can be integrally formed when the component is formed by die-casting.

However, in this case, if an aluminum-alloy material is used as a casting material, the aluminum alloy is apt to stick to the core pin. Accordingly, the threads may be broken when the core pin is rotated and drawn. Therefore, it is hard to stably form the female screw in the component. On the contrary, if the female screw is tapped in the die-cast component made of aluminum-alloy material, manufacturing process becomes complicated.

SUMMARY OF THE INVENTION

In view of the foregoing problems, it is an object of the present invention to provide a die forming method, which can stably form a female screw with a simple manufacturing process.

A die forming method in the present invention is for forming a molded product having a female-thread section. The die forming method includes a filling process, a solidification process, and a thread-drawing process.

In the filling process, a molten material or a semiliquid material is filled into a die including a core pin for forming a female-thread section. In the solidification process, the molten material or the semiliquid material filled in the filling process is cooled and solidified to form a molded product. In the thread-drawing process, the core pin is drawn while being rotated from the molded product after the solidification process. The molten material or the semiliquid material filled in the filling process is a magnesium-alloy material.

A magnesium-alloy material has a characteristic which is not apt to stick to the die including the core pin, compared with an aluminum-alloy material. Therefore, the product having the female-thread section can be integrally formed, when the product is formed using the die including the core pin. Thus, the female-thread section can be stably formed without complicated forming process.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

[First Embodiment]

Figure 1:
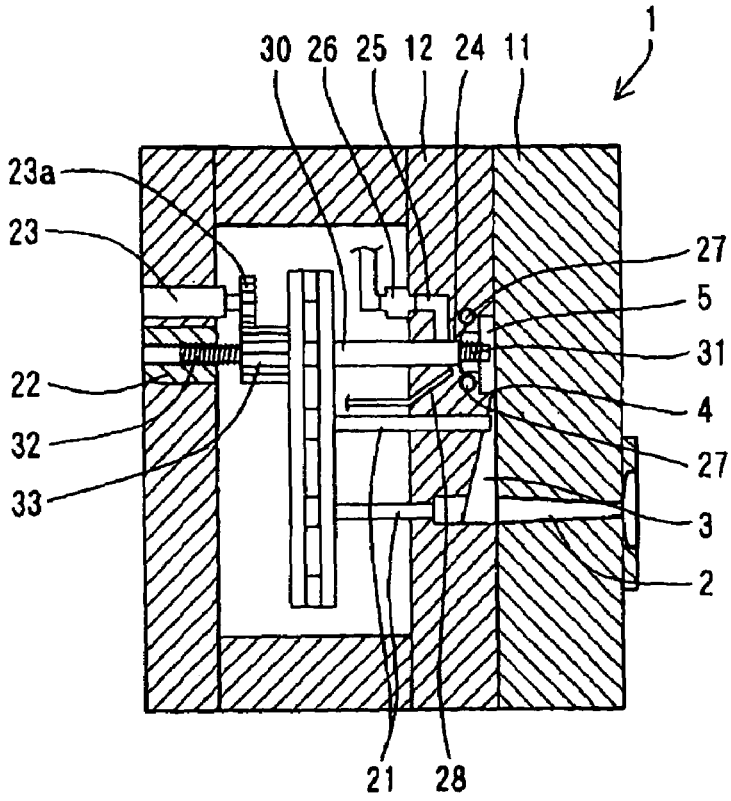
FIG. 1 is a schematic cross-sectional view showing a die according to a first embodiment of the present invention.

As shown in FIG. 1, a die 1 is used for injection molding of a molten metallic material or a semiliquid metallic material (a magnesium alloy material in this embodiment). The die 1 is constructed with a fixed die 11 and a movable die 12. Both dies 11, 12 are made of steel material. A sprue 2 is defined in the fixed die 11. A runner 3 is connected with a lower end section of the sprue 2. A product section 5 is formed on the end of the runner 3 through the gate 4.

An inline-type screw injection molding apparatus (not shown) is used in this embodiment, for example. In the injection molding apparatus, a nozzle section is located in an end section of an outer cover of a screw. The nozzle section fits in the opening section of the sprue 2 of the die 1, when injection molding is performed. The sprue 2 and the runner 3 construct a supplying passage for supplying a metallic material into the product section 5 in the die 1.

Ejector pins 21 are provided in the movable die 12. The ejector pins 12 move to the right in FIG. 1, so that a solidified metallic material, which is formed in the product section 5 and the supplying passage, can be removed from the movable die 12.

Figure 2:
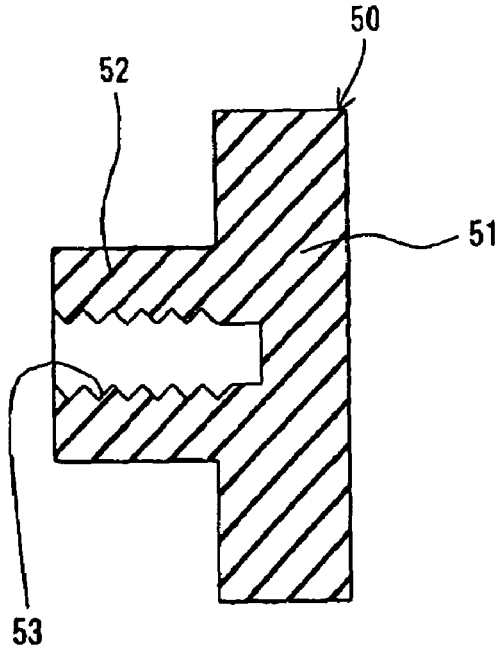
FIG. 2 is a schematic cross-sectional view showing a molded product.

As shown in FIG. 2, a molded product 50 is constructed with a flat-shaped plate section 51 and a cylindrical section 52, which perpendicularly extends from the plane of the plate section 51. A female thread 53 is formed in the inner periphery of the cylindrical section 52.

Referring back to FIG. 1, a screw-shaped pin (core pin) 30 is partially received in a sliding hole 24 of the movable die 12. The screw-shaped pin 30 has a female-thread forming section (screw-shaped portion) 31 on its end section, which is located on the right side in FIG. 1. The female-thread forming section 31 can slide in the sliding hole 24, so as to project into the product section 5. The female-thread forming section 31 is formed in a male-screw shape, so as to correspond to the female thread 53 of the molded product 50. The screw-shaped pin 30 is made of a steel material. The surface of the female-thread forming section 31 is coated with a ceramic material, so that a ceramic material layer (inert material layer) is formed. The ceramic material has a low reactivity with respect to a magnesium alloy material.

A screw section 32 is formed in the screw-shaped pin 30 on the left side end section in FIG. 1. The screw section 32 has a male screw, which has a same screw pitch as a screw pitch of the female-thread forming section 31. The screw section 32 is screwed into a female screw formed in a guide section 22, which is provided in the movable die 12. The screw section 32 is slid while being rotated in the guide section 22. Therefore, the screw-shaped pin 30 is rotated, so that the female-thread forming section 31 can be slid into the product section 5. The female-thread forming section 31 can also be slid out of the product section 5. A gear 33 is provided on the right side of the screw section 32 of the screw-shaped pin 30 in FIG. 1. The gear 33 engages with a gear 23*a* which is coupled with a driving motor 23. Driving force of the driving motor 32 is transmitted by the gears 23*a* and 33, so that the screw-shaped pin 30 is rotated.

A fluid passage 25 is defined in the movable die 12, and communicated with the sliding hole 24 on the downstream side end of the fluid passage 25. A fluid nozzle 26 is provided on the upstream side end of the fluid passage 25, so that fluid can be discharged into the fluid passage 25. The fluid is mold lubricant.

A heater (temperature control means) 27 is provided in the movable die 12 for controlling temperature vicinity of the product section 5 of the movable die 12. A temperature sensor (temperature detecting means) 28 detects temperature of the product section 5 of the movable die 12. A thermocouple is used for the temperature sensor 28. The heater 27 is energized and heated based on the detection signal of the temperature sensor 28, so that vicinity of the product section 5 including the female-thread forming section 31 of the die 1 is controlled at a predetermined temperature.

Figure 3:
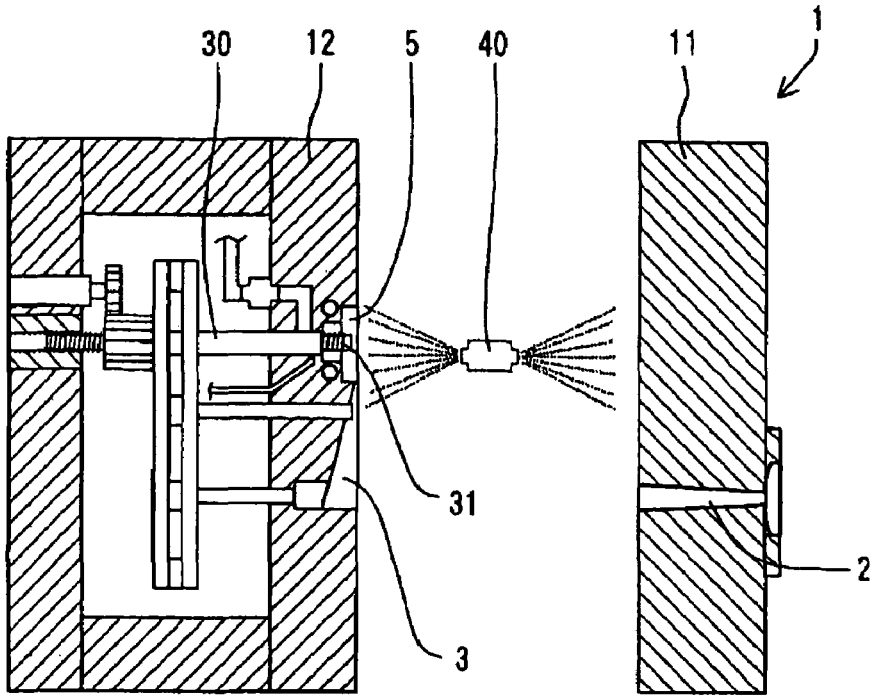
FIG. 3 is a schematic cross-sectional view showing an application process of mold lubricant in a forming process of the molded product.

As shown in FIG. 3, the die 1 is opened and separated into the fixed die 11 and the movable die 12 in the beginning of a forming process of the molded product 50. An application nozzle 40 is located between the fixed die 11 and the movable die 12 for applying mold lubricant. Mold lubricant is applied to the inside plane of the product section 5 or the like. Water-soluble mold lubricant is applied from the application nozzle 40, however oil-based mold lubricant or the like can be applied from the application nozzle 40. In this state, the screw-shaped pin 30 is slid to the right in FIG. 3, 80 that the female-thread forming section 31 is projected into the product section 5.

Figure 4:
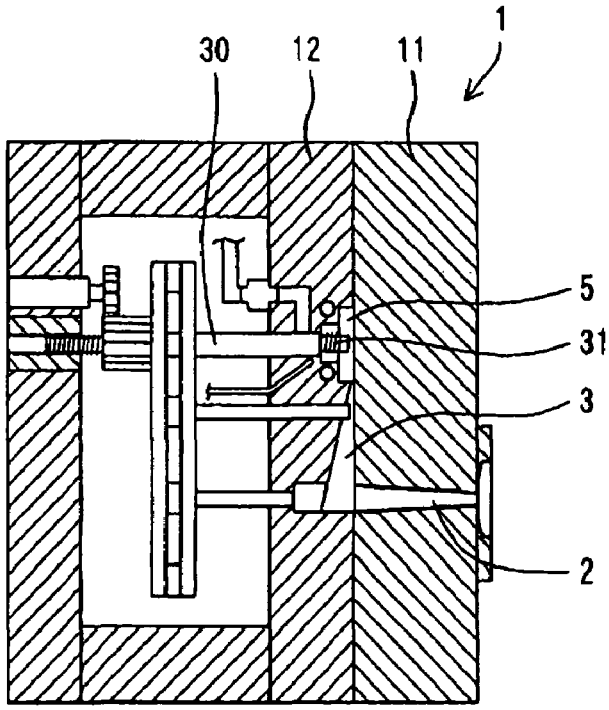
FIG. 4 is a schematic cross-sectional view showing a clamped die after the application process of mold lubricant.

Next, as shown in FIG. 4, the movable die 12 is moved, so that the fixed die 11 and the movable die 12 (i.e., die 1) are clamped together after application of mold lubricant. The nozzle section (not shown) of the injection molding apparatus (injection unit) is connected with the upstream side end of the sprue 2, after clamping the die 1.

Figure 5:
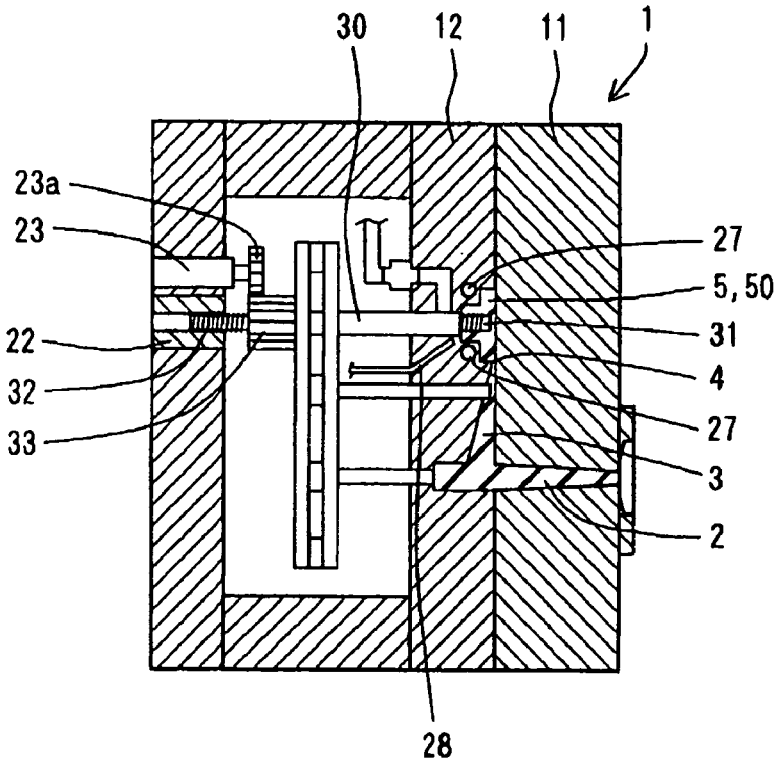
FIG. 5 is a schematic cross-sectional view showing a filling process of a magnesium-alloy material and a solidification process.

As shown in FIG. 5, a molten magnesium alloy material is injected from the nozzle section of the injection unit (not shown) into the product section 5 through the sprue 2, the runner 3, and gate section 4, so that the inside space of the product section 5 is filled with molten magnesium alloy. The molten magnesium alloy material is heated at 600° C., and injected at 2 m/sec (screw speed of the injection unit), 60 that the product section 5 of the die 1 is filled with the magnesium alloy material. For example, alloy number AZ91D is used for the magnesium-alloy material in this embodiment. The injection material can be a semiliquid material, such as alloy number AZ91D heated between 560° C. and 570° C. Here, the semiliquid material partially includes solid state portions. The material can be AM50A, AM60B, or the like. Namely, a molten material and a semiliquid material (i.e., fluidic material) can be used for the die forming method in the present embodiment.

When molten-state magnesium-alloy material is filled into the product section 5, the die 1 removes heat from the magnesium-alloy material, so that the magnesium ally material is cooled and solidified. Thus, the molded product 50 (FIG. 2) is formed in the product section 5 of the die 1. The female screw section 31 is drawn while being rotated from the molded product 50 after the magnesium-alloy material is cooled to a predetermined temperature and solidified.

At least the vicinity of the product section 5 of the die 1 is temperature-controlled at a predetermined temperature by the heater 27 and the temperature sensor 28 before the molten magnesium alloy material is filled. The predetermined temperature is 200° C., for example. A molten magnesium-alloy material is filled into the die 1, so that temperature of the die 1 is once quickly increased. Subsequently, temperature of the die 1 decreases to the predetermined temperature (200° C. in this embodiment). Temperature of the die 1 is measured by the temperature sensor 28 while the die 1 is cooled down. The female-thread forming section 31 is drawn while being rotated from the molded product 50 after the temperature of the die 1 is decreased to the predetermined temperature.

Figure 6:
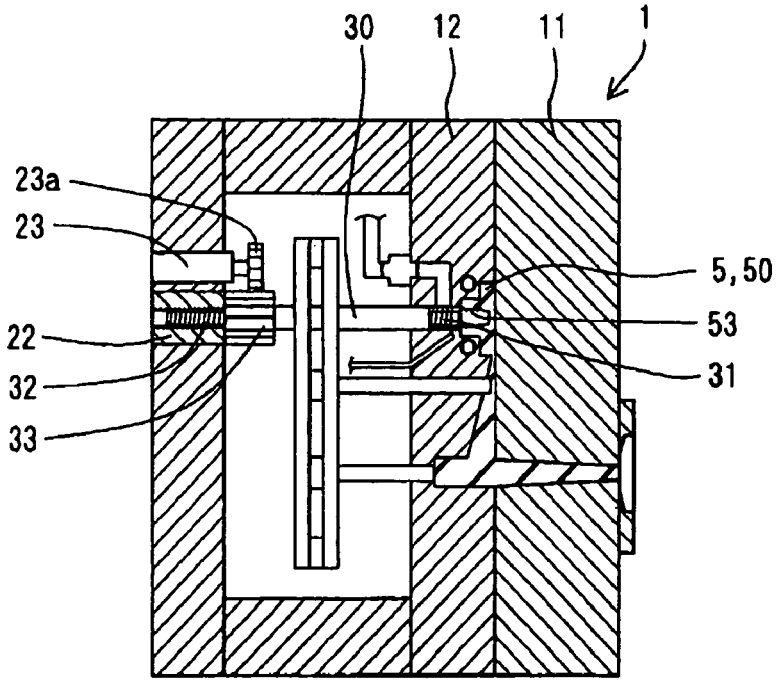
FIG. 6 is a schematic cross-sectional view showing a drawing process of a screw section from a female thread forming section.

The driving motor 23 drives the screw-shaped pin 30 via the engaged gears 23*a*, 33. As shown in FIG. 6, the screw-shaped pin 30 is rotated, so that the screw-shaped pin 30 is moved to left in FIG. 6 by a rotation-sliding mechanism, which is constructed with the guide section 22 and the screw section 32. The screw pitch of the rotation-sliding mechanism is the same as the screw pitch of the female-thread forming section 31. Therefore, the female-thread forming section 31 is drawn to left in FIG. 6, while being rotated along the female thread 53 formed in the solidified molded product 50.

Figure 7:
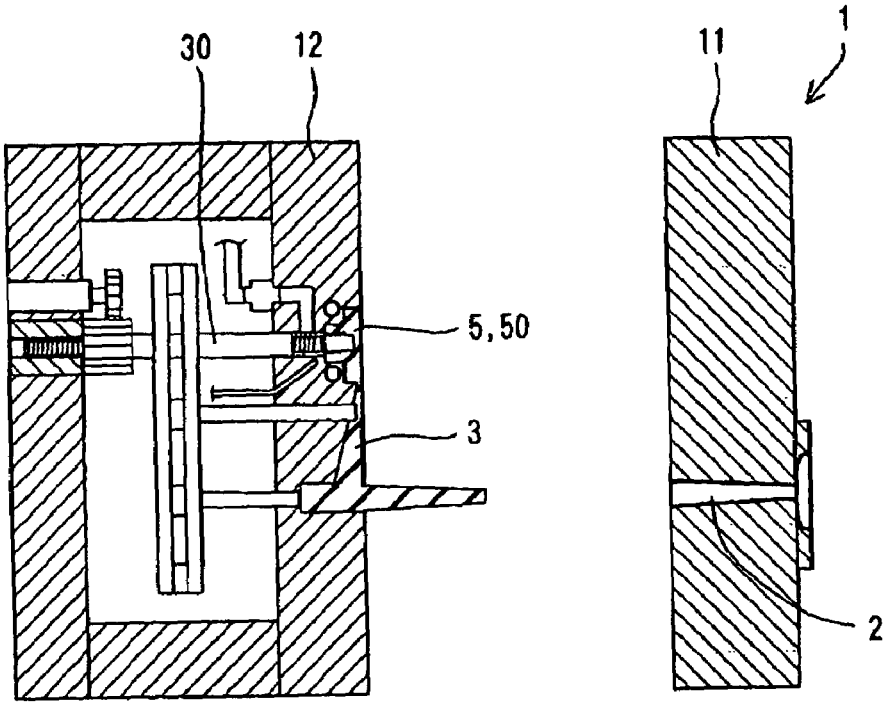
FIG. 7 is a schematic cross-sectional view showing an opened die after finishing the drawing process of the screw section.
Figure 8:
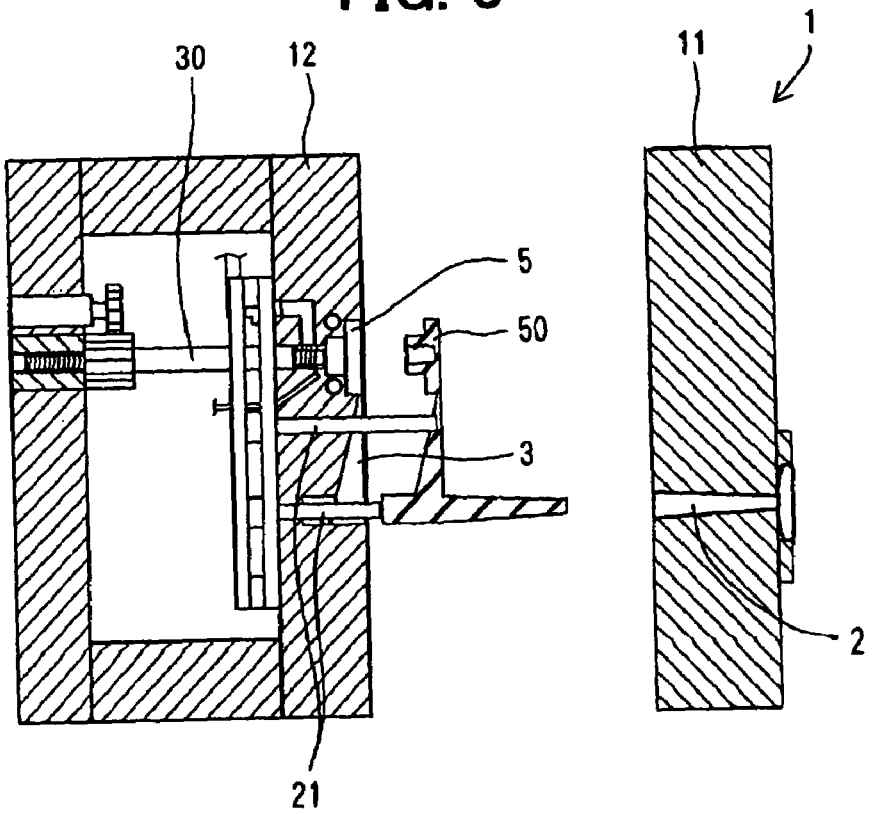
FIG. 8 is a schematic cross-sectional view showing an opened die after finishing the drawing process of the screw section.

As shown in FIG. 7, the movable die 12 is moved so that the die 1 is opened after the female-thread forming section 31 is completely drawn from the molded product 50 (i.e., product section 5). As shown in FIG. 8, the ejector pins 21 are moved to right in FIG. 6, so that the molded product 50 and a solidified member molded in the supplying passage are removed from the movable die 12.

The solidified member molded in the supplying passage is cut at a position corresponding to the gate section 4, and removed from the molded product 50. Thus, the molded product 50 having the female thread 53 (FIG. 2) is obtained. The position of the screw-shaped pin 30 and the ejector pins 21 are reset to an initial position as shown in FIG. 3 after removing the molded product 50 or the like. Subsequently, the die 1 is used in the next molding process.

Preferably, when the above forming cycle is repeated, forming process condition is uniformed in the substantially same condition. Especially, it is preferable that the starting temperature of the drawing of the thread-shaped pin 30 is uniformly adjusted. According to the forming process in this embodiment, the female-thread forming section 31 is used for drawing the thread-shaped pin 30 from the molded product 50. The female-thread forming section 31 is commonly used for plural forming processes. Namely, the dimension of the female-thread forming section 31 can be uniformed for plural forming processes. Accordingly, variation can be decreased in the dimension of the female thread 53 among plural molded products 50.

Here, an application process is shown in FIG. 3. A filling process is shown in FIG. 5. The filled metallic material shown in FIG. 5 is cooled and solidified in a solidification process. A thread-drawing process is shown in FIG. 6.

Figure 9:
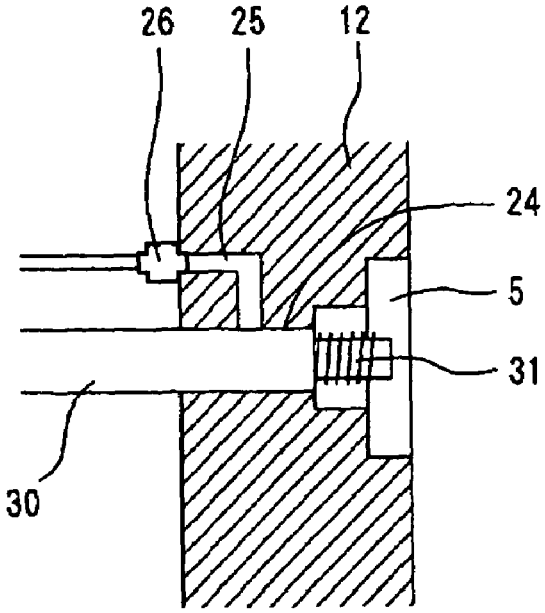
FIG. 9 is a schematic cross-sectional view showing a state before a cooling process.
Figure 10:
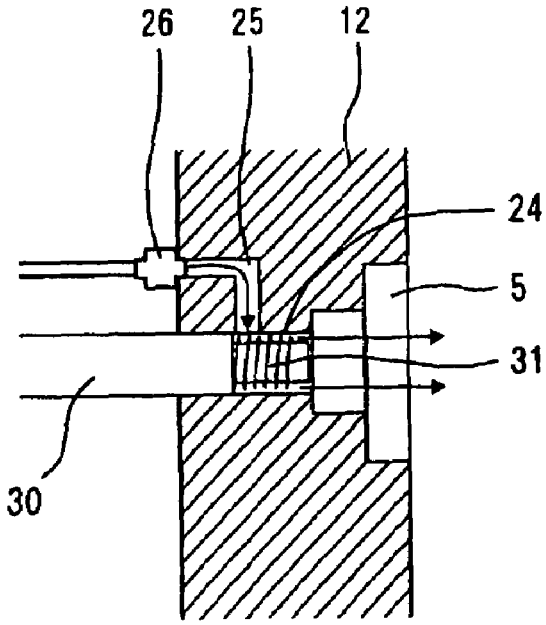
FIG. 10 is a schematic cross-sectional view showing the cooling process.

When the above forming process is repeated, a cooling process is performed in advance of the filling process. The thread-shaped pin 30 is cooled in the cooling process. In the above forming cycle, the thread-shaped pin 30 is in the position shown in FIG. 9, and closes the downstream end of the fluid passage 25 in the sliding hole 24 in the processes shown in FIGS. 3 to 5. Subsequently, as shown in FIG. 10, the downstream end of the fluid passage 25 is opened to the sliding hole 24 after the thread-shaped pin 30 is drawn and the molded product 50 is removed. The downstream end of the fluid passage 25 is communicated with the product section 5 and the exterior of the product section 5 through a thread section of the female-thread forming section 31. Liquid-form mold lubricant is discharged from the fluid nozzle 26, and flows along the thread section of the female-thread forming section 31. Thus, the mold lubricant is applied over the female-thread forming section 31 while cooling the female-thread forming section 31. Therefore, the female forming section 31 can be easily cooled.

The thread-shaped pin 30 is an individual component with respect to the movable die 12. Temperature of the female-thread forming section 31 of the thread-shaped pin 30 is apt to be increased. However, the female-thread forming section 31 can be steadily cooled, so that temperature of the female-thread forming section 31 becomes low, for example 200° C. Therefore, reactivity can be decreased between the female-thread forming section 31 and a molten magnesium alloy material after the filling process. The applied mold lubricant decreases friction between the female-thread forming section 31 and the female thread 53 of the molded product 50 in the thread-drawing process, so that the molded product 50 can be easily removed from the die 1. The mold lubricant is applied to the inner plane of the sliding hole 24, so that lubrication between the sliding hole 24 and the thread-shaped pin 30 can be maintained.

The above process is the cooling process perform d in advance of the filling process. Preferably, the cooling temperature is set below 300° C. The inventors confirmed that sticking between the female-thread forming section 31 and the female thread 53 is not apt to occur in the case that the cooling temperature is below 300° C., compared with the case that the cooling temperature is above 300° C.

In the above construction and the forming process, a molten magnesium-alloy material is filled into the die I in the filling process. A magnesium-alloy material has a characteristic, such that the magnesium-alloy material is not apt to stick to a steel material compared with an aluminum-alloy material or the like. The steel material is generally used for a die. Therefore, a magnesium-alloy material is not apt to stick to the die 1, especially the female-thread forming section 31 of the thread-shaped pin 30.

A magnesium-alloy material, such as AZ91D or the like, includes several percent of aluminum for enhancing corrosion resistance and strength. However, the ceramic material layer is formed on the surface of the female-thread forming section 31. Besides, mold lubricant is applied to the inside plane of the product section 5, especially the female-thread forming section 31, in advance of the filling process. Therefore, even if aluminum material, which is apt to stick to a steel material, is included in the magnesium-alloy material, contact can be prevented between the die material (i.e., the steel material) and the aluminum material included in the magnesium alloy material.

The female-thread forming section 31 is steadily cooled in the cooling process, in advance of the filling process. Therefore, even if the aluminum material included in the magnesium alloy material contacts the die material of the female-thread forming section 31, sticking is not apt to occur.

Thus, it is not necessary to individually form the female thread 53 of the molded product 50 in another process, such as a machining work process. Besides, the female-thread section 53 can be steadily formed when the molded product 50 is formed.

Conventionally, similar product is molded of resin, and a female screw section is formed as a connecting section at the same time. However, it is difficult to secure connecting strength in this resinous molding. Otherwise, insert molding process or press insertion process is used when high strength is required for the connecting section. Here, a metallic part having a female thread is inserted by a molding material, such as resin, in the insert molding process. A metallic part having a female thread is press-inserted into a component in the press-insertion process. However, both the insert molding process and the press insertion process have complicated processes. On the contrary, in this embodiment, a female screw can be steadily formed without complicated process. Accordingly, the process in this embodiment is significantly effective in cost reduction or the like.

[Other Embodiment]

The fluid, which is discharged from the fluid-nozzle 26, is not limited to mold lubricant. Other fluid, which cools the female-thread forming section 31, can be substituted for the mold lubricant. Antifriction can be used for cooling and lubricating. Air, especially cooled air, or water can be used for cooling, for example.

The temperature control means is not limited to the heater 27. A heat medium piping can be provided in the die 1, for example. In detail, heat medium, such as oil, air, and water is circulated inside the heat medium piping, so that the die 1 is heated, and temperature of the die 1 is controlled.

The die-opening force can be converted into a rotational force using a specific mechanism, 60 that the die can be opened while drawing the thread-shaped section.

A thixotropic molding, in which semiliquid state magnesium alloy is injection-molded, can be used for the forming process. Die-casting, squeeze casting, low-pressure casting, gravity casting, and the like can be also used for the forming process. As long as the forming process uses a die, the present invention can be used.

Various modifications and alternation may be made to the above embodiments without departing from the spirit of the present invention.

What is claimed is:

1. A die forming method for forming a molded product having a female-thread section comprising:

a filling process in which a fluidic material is filled into a die including a core pin having a screw-shaped portion, which is made of a steel material, shaped in correspondence with the female-thread section;

a solidification process in which the fluidic material filled in the filling process is cooled and solidified to form the molded product; and a thread-drawing process in which the screw-shaped portion of the core pin is drawn while being rotated from the molded product after the solidification process, wherein the fluidic material filled in the filling process is a magnesium-alloy material, wherein a plurality of molded products are formed over a plurality of times; and wherein a temperature of the core pin is adjusted to be at a substantially same pre-heating temperature when the thread-drawing process is performed for the plurality of times.

2. The die forming method according to claim 1, wherein:

the core pin has a surface on which an inert material layer is formed; and the inert material layer has low reactivity with respect to the fluidic material.

3. The die forming method according to claim 1, further comprising an application process, in which mold lubricant is applied to a surface of the core pin, in advance of the filling process.

4. The die forming method according to claim 1, further comprising a cooling process, in which the core pin is cooled, in advance of the filling process.

5. The die forming method according to claim 4, wherein the core pin is cooled to be below 300° C. in the cooling process.

6. The die forming method according to claim 4, wherein the cooling process includes discharging fluid to the core pin so that the core pin is cooled in the cooling process.

7. The die forming method according to claim 6, wherein the fluid is mold lubricant.

8. The die forming method according to claim 1, wherein:

a temperature of a cavity defined in the die is detected by a temperature detecting means, wherein the product is molded in the cavity; and a temperature of a vicinity of the cavity including the female-thread forming section is controlled by a temperature control means, wherein the temperature control means is energized and heated based on a detection signal of the temperature detecting means, so that the vicinity is controlled at a predetermined temperature at least in advance of the filling process.

9. The die forming method according to claim 8, wherein the temperature control means is a heater.

10. The die forming method according to claim 8, wherein the temperature detecting means is a thermocouple.

11. The die forming method according to claim 1, wherein:

a temperature of a cavity defined in the die is detected by a temperature detecting means, wherein the product is molded in the cavity; and a heat medium is circulated inside a heat medium piping defined in the die, to heat the cavity, so that the temperature of the cavity is controlled at a predetermined temperature at least in advance of the filling process.

12. A die forming method for forming a molded product having a female-thread section, the die forming method comprising:

filling a fluidic material into a die in a filling process, the die including a core pin having a screw-shaped portion;

cooling and solidifying the fluidic material filled in the filling process to form the molded product in a solidification process; and drawing the screw-shaped portion of the core pin while being rotated from the molded product in a thread-drawing process, wherein:

a temperature of the core pin is adjusted at a predetermined pre-heated temperature in at least a beginning of the thread-drawing process; and the predetermined temperature of the core pin is substantially same for a plurality of times of forming a respective plurality of molded products.

13. The die forming method according to claim 12, further comprising:

detecting a temperature of a cavity defined in the die and providing a detection signal responsive thereto; and energizing a temperature control means to be heated responsive to the detection signal, so that a vicinity of the cavity including the female-thread forming section is controlled at the predetermined temperature at least in advance of the filling process.

14. The die forming method according to claim 12, further comprising:

detecting a temperature of a cavity defined in the die; and circulating a heat medium inside a heat medium piping defined in the die, to heat the cavity of the die at least in advance of the filling process.

15. A die forming method for forming a molded product having a female-thread section, the die forming method comprising:

lubricating a core pin in a lubricating process;

applying lubricant over a female-thread forming section in the lubricating process;

filling a fluidic material into a die in a filling process, the die including a core pin having a screw-shaped portion;

cooling and solidifying the fluidic material filled in the filling process to form the molded product in a solidification process; and drawing the screw-shaped portion of the core pin while being rotated from the molded product in a thread-drawing process, wherein:

the core pin and the female-thread forming section are cooled, so that a temperature of the core pin and the female-thread forming section becomes below 300° C. in the lubricating process.

16. The die forming method according to claim 15, wherein:

the temperature of the core pin is adjusted at a predetermined temperature in at least a beginning of the thread-drawing process; and the predetermined temperature of the core pin is substantially same for a plurality of times of forming a respective plurality of molded products.

* * * * *